US006872140B2

(12) United States Patent
Ishida

(10) Patent No.: US 6,872,140 B2
(45) Date of Patent: Mar. 29, 2005

(54) RACING GAME MACHINE

(75) Inventor: Tetsuo Ishida, Tokyo (JP)

(73) Assignee: Konami Corporation, Tokyo (JP)

( * ) Notice: Subject to any disclaimer, the term of this patent is extended or adjusted under 35 U.S.C. 154(b) by 273 days.

(21) Appl. No.: 10/109,846

(22) Filed: Apr. 1, 2002

(65) Prior Publication Data

US 2002/0151367 A1 Oct. 17, 2002

(30) Foreign Application Priority Data

Apr. 2, 2001 (JP) ..... P.2001-103559

(51) Int. Cl.[7] ..... A63F 9/14; A63H 30/04
(52) U.S. Cl. ..... 463/58; 463/61
(58) Field of Search ..... 463/1, 4, 6, 16, 463/46, 58, 61, 62, 63; 273/227, 239, 138.2; 446/444, 446, 455; 104/60

(56) References Cited

U.S. PATENT DOCUMENTS

| | | | | |
|---|---|---|---|---|
| 2,188,619 A | | 1/1940 | Bernhardt | |
| 3,815,912 A | * | 6/1974 | Wichinsky et al. | 463/68 |
| 4,658,928 A | * | 4/1987 | Seo | 180/168 |
| 4,990,117 A | * | 2/1991 | Yonezawa | 446/136 |
| 5,601,490 A | * | 2/1997 | Nakagawa et al. | 463/63 |
| 5,865,661 A | * | 2/1999 | Cyrus et al. | 446/136 |
| 5,928,058 A | * | 7/1999 | Francis et al. | 446/446 |
| 6,102,770 A | * | 8/2000 | Cyrus et al. | 446/444 |
| 6,695,668 B2 | * | 2/2004 | Donahue et al. | 446/175 |

FOREIGN PATENT DOCUMENTS

| | | |
|---|---|---|
| JP | 50-15989 | 2/1975 |
| JP | 57-123191 | 7/1982 |
| JP | 59-22106 | 2/1984 |
| JP | 1-259404 | 10/1989 |
| JP | 2650643 | 5/1997 |
| JP | 9-192347 | 7/1997 |
| JP | 9-305225 | 11/1997 |
| JP | 9-319433 | 12/1997 |
| JP | 10-105234 | 4/1998 |
| JP | 10-232712 | 9/1998 |
| JP | 11-244517 | 9/1999 |

* cited by examiner

*Primary Examiner*—Mark Sager
(74) *Attorney, Agent, or Firm*—Sughrue Mion, PLLC

(57) ABSTRACT

A plurality of guide lines are provided on a lower traveling field. A first detector is provided with each self-propelled member to detect at least one of the guide lines optically or magnetically. A second detector is provided with each self-propelled member to output a displacement signal which indicates a displaced distance from a predetermined position. A travel controller is provided with each self-propelled member, and performs a feedback control such that the self-propelled member travels on the lower traveling field while tracing the at least one guide line. A plurality of miniature members, each associated with one self-propelled member are placed on a upper traveling field extending above the lower traveling field. The miniature members travel thereon in accordance with the traveling of the self-propelled members through magnetic force. A central controller collectively monitors the displacement signal of each self-propelled member to recognize relative position relationship among the self-propelled members, and issues at least a speed changing instruction and a path-switching instruction for each self-propelled member, based on the relative position relationship. The travel controller of each self-propelled member changes a traveling speed thereof according to the speed changing instruction, and switches a traveling path thereof from the traced guide line to another guide line, according to the path-switching instruction.

17 Claims, 4 Drawing Sheets

RACING GAME MACHINE

BACKGROUND OF THE INVENTION

The present invention relates to a racing game machine, and more particularly, to a travel control system for self-propelled members of the racing game machine such as a horseracing game machine, an auto racing machine, or a motorcycle racing machine.

Various types of racing game machines which enable players to enjoy a variety of games differ from each other in terms of the aspect of a game (i.e., the nature of a game to be played) or the aspect of a race (i.e., the nature of a race to be performed). Further, in terms of the aspect of miniatures, racing game machines can be roughly categorized into racing game machines which cause pictorial miniatures to compete with each other, and racing game machines which cause real miniatures to compete against each other. Regardless of whether a racing game is effected through use of pictorial or real miniatures, and regardless of the nature of a "race" to be enjoyed, racing game machines have evolved in pursuit of realism of a race run by miniatures. These racing game machines are based essentially on a race to be performed by miniatures and have evolved primarily from a racing game machine employing miniatures.

Travel or racing of miniatures in a racing game machine which employs pictorial miniatures is controlled with comparative ease, by a microcomputer (i.e., various available race patterns are sequentially selected according to a predetermined rule, and for each race pattern a travel route or speed of each of the miniatures is defined so as to correspond to the thus-selected race pattern). For this reason, in connection with diversification of combinations of racehorses, diversification of races to be performed, and a game control technique such as realization of realistic race control, racing game machines employing pictorial miniatures have preceded racing game machines employing real miniatures (as described in, e.g., Japanese Utility Model Publication No. 57-123191U).

There also exists a so-called two-storied racing game machine comprising an upper traveling field (racing track) and a lower traveling field located below the upper traveling field. Self-propelled members travel over the lower traveling field, while individually guiding miniatures placed on the upper traveling field through magnetic force such the miniatures are caused to compete with each other.

At the beginning of development of such games, in view of restrictions on a travel control technique, there was no alternative but to cause self-propelled members to travel along rails. Miniatures are caused to compete with each other by controlling only traveling speeds of the self-propelled members (as described in, e.g., U.S. Pat. No. 2,188,619). Against the backdrop of an upward leap in the processing speed of a microcomputer, an upward leap in memory capacity, and a decrease in the cost of a microcomputer and in that of memory, various attempts have been made to realize a race control technique in a game machine using real miniatures, wherein the technique was originally intended for a game machine which uses pictorial miniatures and enables diversification of combinations of racehorses, diversification of races, and realization of realistic race control.

With the understanding that a racing game machine which guides miniatures along rails considerably reduces players' interests, one example of a racing game machine implements trackless travel of self-propelled members by feedback control in accordance with a program (as described in, e.g., Japanese Patent No. 2650643). In this case, the principal technological challenge to be met is development of a travel control technique for a miniature which causes real miniatures to travel, without fail, in accordance with a game program (i.e., travel routes of respective self-propelled members, successive traveling speeds, and the order of arrival); miniaturization of self-propelled members; and development of a control program for causing self-propelled members to travel smoothly and stably along a straight or curved line.

In association with development of computer technology, in place of a technique for guiding miniatures along physical tracks (such as rails or grooves), there has already been developed a travel control technique for controlling travel of various self-propelled members by guiding the miniatures along guide lines and regulating travel paths. Since the travel course is regulated by guide lines, the technique has an advantage of affording simple travel control. In contrast with a control technique using rails, the technique has an advantage of miniatures being able to leave guide lines. An example of guide travel control technology using guide lines is described in, e.g., Japanese Patent Publication No. 59-22106A. The control technology is for causing miniatures to follow guide lines while the guide lines are detected electromagnetically, magnetically, or optically.

Like the technique described in Japanese Patent No. 2650643, a technique of controlling travel of self-propelled members in accordance with a control program which defines travel paths, traveling speeds, and the order of arrival, by sequentially detecting positions of the self-propelled members on a two-dimensional plane, and feedback control on the basis of the thus-detected data pertaining to positions presents practical problems such as those described below.

More specifically, travel of self-propelled members in a real racing game does not always become stable and may fail to proceed as scheduled, for reasons of slippage of wheels. Alternatively, travel of self-propelled members undeniably becomes less smooth and unnatural because of slow response of self-propelled members to feedback control. For these reasons, realization of a race through apparently natural travel is not easy.

In a real horserace, racehorses substantially run along comparatively smooth paths corresponding to combinations of straight lines and gently-curved lines. The racehorses do not change their courses frequently. Consequently, even in the case of a racing game machine, travel of miniatures along comparatively smooth paths corresponding to combinations of straight lines and gently-curved lines seems more natural. Such travel can be seen as closely simulating a real horserace run by racehorses and offering realism.

Guided travel of self-propelled members along tracks is more smooth, stable, natural, and easy to control.

In a real horserace, individual racehorses change their courses not in accordance with a predetermined program but by assessment of the situation by jockeys in consideration of their positions in corners and the condition of a group of horses. Miniatures, whose travel paths, including course changes, have been programmed beforehand, is not always driven as programmed. Hence, the race lacks realism and produces a feeling of artificiality. Regardless of how much a program is improved, the feeling cannot be eliminated completely.

In the case of a racing game machine which effects travel control such that each of the miniatures follow a single guide line from beginning to end, the progress of a race undeniably lacks realism, because of a simple travel path and a simple, artificial race.

SUMMARY OF THE INVENTION

It is therefore an object of the invention to provide a racing game enabled to render travel of respective self-propelled members more practical and smooth; and changing travel courses and positioning the self-propelled members in accordance with the ever-changing condition of a group of horses, on the basis of the well-known racing game system involving tracked travel operation to thereby realize progress of a horserace in the manner of a real horserace.

In order to achieve the above object, according to the present invention, there is provided a racing game machine, comprising:

a lower traveling field;

a plurality of guide lines provided on the lower traveling field;

a plurality of self-propelled members, each including:

a first detector, which detects at least one of the guide lines by at least one of optically and magnetically;

a second detector, which outputs a displacement signal which indicates a displaced distance from a predetermined position; and a travel controller, which performs a feedback control such that the self-propelled member travels on the lower traveling field while tracing the at least one guide line;

an upper traveling field, extending above the lower traveling field;

a plurality of miniature members, each associated with one self-propelled member, the miniature members placed on the upper traveling field so as to travel thereon in accordance with the traveling of the self-propelled members through magnetic force;

a central controller, which collectively monitors the displacement signal of each self-propelled member to recognize relative position relationship among the self-propelled members, and which issues at least a speed changing instruction and a path-switching instruction for each self-propelled member, based on the relative position relationship, wherein the travel controller of each self-propelled member changes a traveling speed thereof when the speed changing instruction is received from the central controller; and wherein the travel controller of each self-propelled member switches a traveling path thereof from the traced guide line to another guide line, when the path-switching instruction is received from the central controller.

Preferably, a reference speed is assigned to each self-propelled member in accordance with a characteristics of an associated miniature member.

In this game machine, deviation of a self-propelled member from a traveling direction is made small by limiting a traveling path with the guide lines. Further, a change in traveling path (i.e., steering action) is effected by path-switching between the guide lines. The path-switching is effected within the bounds for simulating the progress of a real race as faithfully as possible. Therefore, very natural, stable travel of miniature members can be realized. According to the ever-changing relative position relationship among the miniature members during a race, a determination as to a necessity for a change in course or deceleration is made in accordance with predetermined requirements, for example, by simulating conditions under which a jockey makes a determination in a real horserace. Path-switching of a course or deceleration operation is performed on the basis of a result of determination. Hence, the progress of a race performed by the miniature members can be made closely analogous to the progress of a real race.

A traveling course and speed of each self-propelled member are programmed, and the travel of the self-propelled member is subjected to feedback control such that the program is executed on the basis of successive positional information about a two-dimensional coordinate during a race. In such a case, there is a probability of occurrence of various problems, such as runaway which would arise when a self-propelled member has greatly deviated from a predetermined course because of slippage of wheels and is temporarily thrown out of feedback control, thereby ruining a race.

According to the present invention, since the respective self-propelled members are simply trace the guide lines there is no chance of a self-propelled member greatly deviating from a traveling course to enter an uncontrollable state. Therefore, a racing game is performed systematically and very smoothly, thus realizing very realistic progress of a race.

According to the present invention, there is also provided a racing game machine, comprising:

a lower traveling field;

a plurality of guide lines provided on the lower traveling field;

a plurality of progress lines provided on the lower traveling field at constant intervals, so as to perpendicularly cross each guide line;

a plurality of self-propelled members, each including:

an optical detector, which detects at least one of the guide lines;

a magnetic detector, which outputs a displacement signal indicating how many number of progress lines are passed by the self-propelled member from a predetermined position; and a travel controller, which performs a feedback control such that the self-propelled member travels on the lower traveling field while tracing the at least one guide line;

an upper traveling field, extending above the lower traveling field;

a plurality of miniature members, each associated with one self-propelled member, the miniature members placed on the upper traveling field so as to travel thereon in accordance with the traveling of the self-propelled members through magnetic force;

a central controller, which collectively monitors the displacement signal of each self-propelled member to recognize relative position relationship among the self-propelled members, and which issues at least a speed changing instruction and a path-switching instruction for each self-propelled member, based on the relative position relationship, wherein the travel controller of each self-propelled member changes a traveling speed thereof when the speed changing instruction is received from the central controller; and wherein the travel controller of each self-propelled member switches a traveling path thereof from the traced guide line to another guide line, when the path-switching instruction is received from the central controller.

In addition to above advantages, since the guide lines are detected by the optical detector while the progress lines are detected by the magnetic detector, no interference arises between both detections so that the detection error can be effectively avoided. Particularly, avoiding the detection error of the progress lines makes the recognition of the relative position relationship among the miniature members accurate. Further, there is no necessity to provide a two-dimensional position detector.

In addition, since the travel of the self-propelled members is controlled and guided along the guide lines, and the speed of an individual self-propelled member is controlled in accordance with a traveling speed program assigned to the member beforehand, in terms of both software and hardware, travel control of a self-propelled member is very simple, and the accuracy of control operation is high. Further, travel control is performed reliably.

Here, both sensors differing in physical properties from each other, are of importance and sufficient for the invention. The guide lines may be detected by use of a magnetic sensor. In this case, the detector for detecting the progress lines may be embodied as an optical sensor. Another type of sensor; for example, an electromagnetic sensor, may also be used. However, use of a magnetic sensor and an optical sensor in combination is most practical.

Alternatively, information indicating displacement of the self-propelled member may be read from the traveling field, and the thus-read information may be taken as the displacement signal. For instance, bar codes representing the distances from a start point may be printed on the traveling field, and the displacement information can be read directly from the bar codes.

Preferably, the central controller determines a goal-arrival order of a game prior to a start of the race, so as to include at least a first-arrived miniature member and a second-arrived miniature member.

The present invention can be practically applied to a racing game machine which pays tokens for winning.

Preferably, the optical detector includes at least three optical sensors arranged in a direction perpendicular to a traveling direction of the self-propelled member.

When one located in the center of the optical sensors is situated in the center of a guide line, the self-propelled member does not at all deviate from the guide line. If two sensors have detected the guide line and the other sensor has failed to detect the guide line, the self-propelled member is determined to have deviated from the guide line in one direction. In this way, the direction and amount of deviation can be detected. Hence, feedback control for causing the self-propelled member to follow and travel along the center of the guide line can be performed with high accuracy. Consequently, the self-propelled member follows and travels with involvement of small sideway deviations.

Preferably, the guide lines are provided as black lines and white lines which are alternately printed on the lower traveling field.

Guide lines are formed on a traveling field by printing, which provides the most convenient way. In a case where optical sensors of reflection type are used, contrast of a guide line becomes clear, thereby enabling highly accurate control for causing a self-propelled member to follow and travel on a guide line.

Preferably, the central controller issues the speed changing instruction when at least one of the following requirements is satisfied:

i) a speed difference between two of the self-propelled members traveling on the same guide line is a predetermined value or more; and ii) a distance between two of the self-propelled members is a predetermined value or less.

The speed changing instruction is an instruction for decelerating one of the self-propelled members which is situated rearward.

The necessity for switching of a guide line (i.e., a change in traveling course) or deceleration is determined on the basis of the relative position relationship among the self-propelled members in consideration of the above-described requirements. Regardless of the traveling state of an individual self-propelled member, the most practical race is performed. Further, various races can be implemented according to the characteristics of the miniatures.

Here, other requirements can also be added to these requirements. Alternatively, the requirements can be changed to other requirements. The only requirement is to set requirements for switching and deceleration optimal for simulating a real race.

Preferably, the displacement signal is feedback controlled by the central controller or the travel controller.

The trackability of the self-propelled member for the instructions is enhanced, thereby effecting a scheduled race with reliability.

Preferably, the displacement signal is open controlled.

The accuracy of traveling control is dependent on the trackability of the self-propelled member for an instruction. However, traveling control becomes simple.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

An example in which the present invention is applied to a horseracing game machine will now be described by reference to the accompanying drawings.

Figure 1:
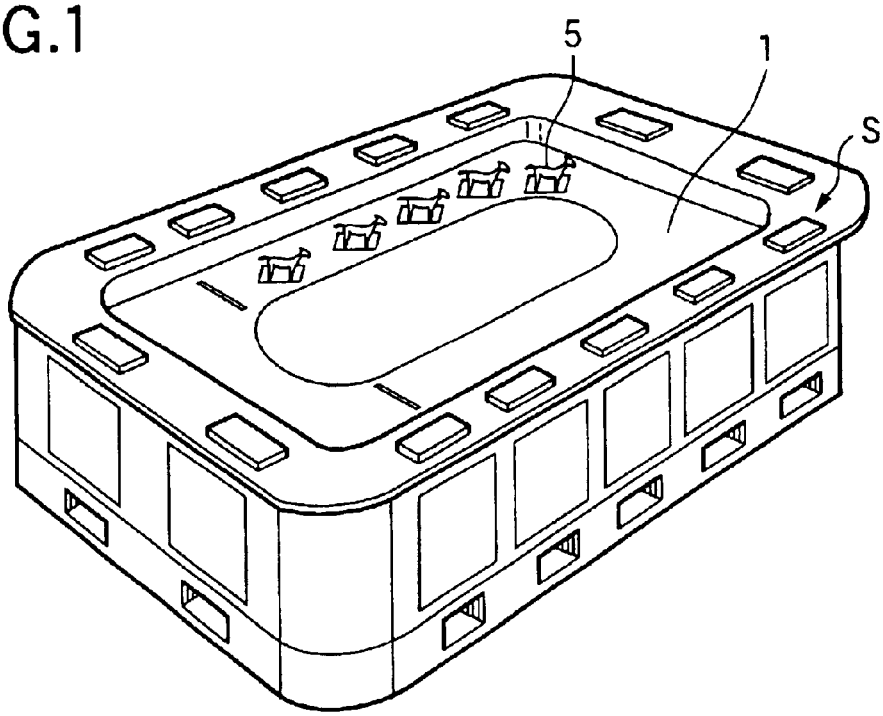
FIG. 1 is an overall perspective view of a horseracing game machine.

The overall structure of a horseracing game machine according to the embodiment is identical with that of a well-known horserace game. As shown in FIG. 1, the horseracing game machine is a large-sized game machine having a width of about 2.5 m and a length of about 4 m. A plurality of satellite terminals S are provided so as to surround a racing track 1 on which miniatures 5 are to perform racing. Each of the satellite terminals S has a token handling mechanism for effecting entry/payout of tokens, a control panel, such as a voting control key, and indictors for indicating various types of information items.

Figure 2:
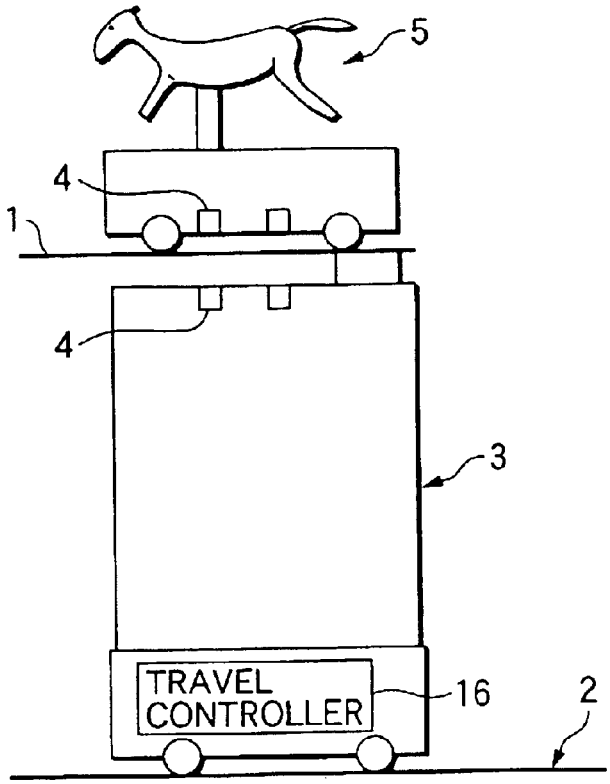
FIG. 2 is a schematic side view showing a miniature and a self-propelled member incorporated in the horseracing game machine.

As shown in FIG. 2, the game machine has an upper traveling field over which miniatures are to travel (hereinafter, referred as a racing track), and a lower traveling field 2 over which self-propelled members are to travel (hereinafter, simply referred as traveling field). Self-propelled members 3, which travel over the lower traveling field 2, attract the miniatures 5 such that the miniatures 5 are caused to compete with each other, by magnetic force originating from magnets 4 provided in the tops of respective self-propelled members 3 located below the corresponding miniatures 5 and in bottoms of the miniatures 5.

As described in, e.g., U.S. Pat. No. 2,188,619, the basic structure of the horseracing game machine is a known structure. The horserace game machine described in the U.S. patent is a machine in which self-propelled members are caused to travel along a rail, and the traveling direction of the self-propelled members is regulated by the rail. Hence, travel control to be effected for racing is limited solely to travel control that is very easy. The present embodiment is based on the game machine described in the U.S. patent, except that the guidance member using a rail is replaced with a well-known optical guidance member.

Figure 3:
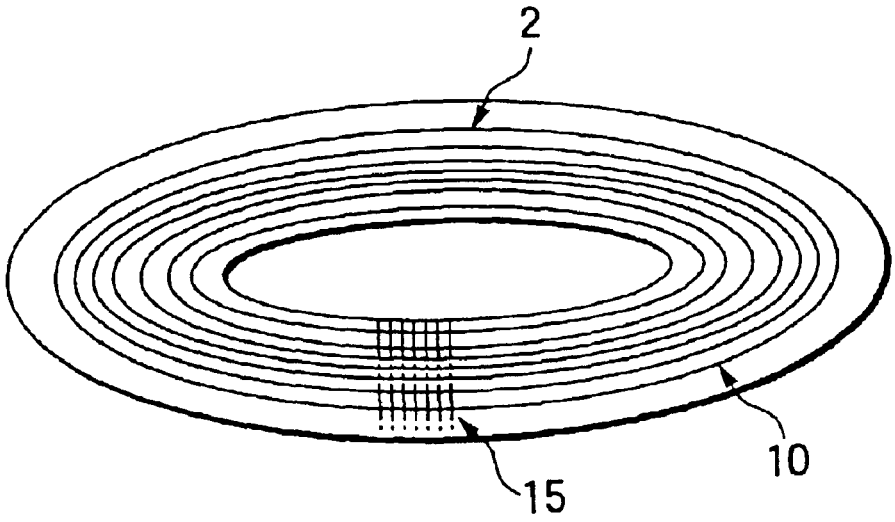
FIG. 3 is a perspective view of a lower traveling field according to one embodiment of the invention.
Figure 4:
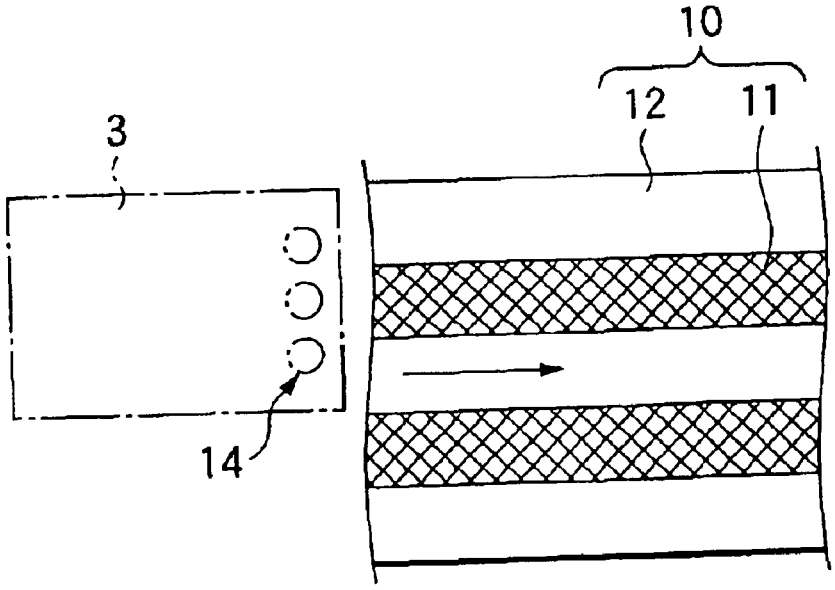
FIG. 4 is an enlarged view showing the relationship between a guide line and a guide line detector according to the embodiment.

As shown in FIGS. 3 and 4, a black line (i.e., a guide line) 11 having a width of 6 mm and a white line 12 having a width of 6 mm are alternately provided and printed on the traveling field 2 along a traveling direction.

The only requirement for determining the width of the guide line 10 is to select an appropriate value from the range of 5 to 10 mm. The white line 12 can be taken as a guide line. In any of these two cases; i.e., the case where the black line 11 is taken as the guide line 10 and the case where the white line 12 is taken as the guide line 10, the width of the guide line 10 is relevant to the layout of a detector (e.g., a photodiode) 14 provided for the guide line 10. The width of a line located on either side of the guide line 10 is selectively determined, as required, in accordance with an interval between the guide lines 10. In the present embodiment, a pitch between the guide lines 10 is 12 mm, which accounts for about 37% the width of the self-propelled member 3; that is, 33 mm.

The pitch between the guide lines 10 corresponds to a path-switching width, which will be described later. If the width is too large, path-switching from one guide line to another guide line becomes less smooth. Preferably, the pitch should be confined to a range in which smooth path-switching can be effected.

In contrast, if the width is too small, the guide lines 10 are provided densely, and consequently the width of a change in traveling courses becomes small. In such a case, the current guide line must be switched to another guide line by skipping two or more guide lines, thereby requiring special path-switching control for specifying the number of guide lines to be skipped. Moreover, if the pitch is too small, the width of each guide line 10 will become too small, thereby imposing difficulty on detecting operation performed by three or more optical sensors. For these reasons, the present embodiment needs a detection system which detects respective sides of each of the guide lines 10 through use of two optical sensors.

In the embodiment, three photodiodes 14 are provided side by side on the lower face of each self-propelled member 3 in a widthwise direction, thus constituting a guide line detector. The width of a range covered by the three photodiodes 14 is 12 mm, which is double the width of the single black line (i.e., guide line) 11. Further, the photodiodes 14 are spaced 6 mm from each other.

If the center photodiode 14 and either the right or left photodiode 14 detect the black line and if the remaining photodiode 14 fails to detect the black line 11, the self-propelled member 3 is determined to have deviated toward the photodiode 14 which does not detect the black line 11. Such deviation is determined by a travel controller 16 provided in each self-propelled member 3, and the course of the self-propelled member 3 is corrected through feedback control. In this way, the self-propelled member 3 follows the guide line 10 while reliably sensing small deviations thereof. As a result, the self-propelled member 3 follows the black line (i.e., guide line) 11 accurately and travels smoothly.

If three optical sensors are provided in a forward portion of the self-propelled member 3 and two or three optical sensors are provided in a rear portion of the same, skewed travel of the self-propelled member 3 with reference to the guide line can also be detected. Hence, the accuracy of a control operation for tracking a guide line, particularly a curved guide line, can be enhanced.

In the event that the self-propelled member 3 has deviated from the guide line, course correction control for rendering smooth travel of the self-propelled member 3 should be gentle.

The order of arrival in the racing game cannot be taken care of themselves in view of the odds of the game. For this reason, at least a miniature for the first place and a miniature for the second place must be determined before a game is started. In other words, determination of miniatures for the first and second places is sufficient. Effecting control such that the thus-determined miniatures gain scheduled places and sequentially ascertaining the condition of a group of horses makes detection of progress in respective horses from the start is important.

Figure 5A:
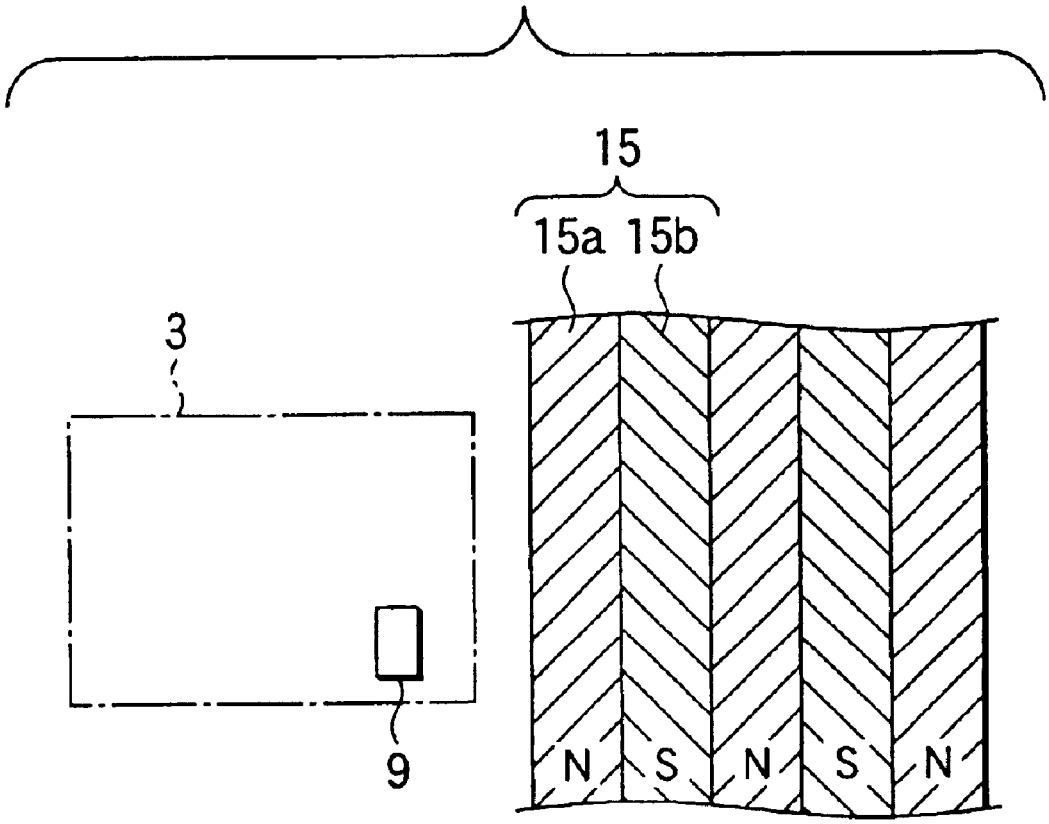
FIG. 5A is an enlarged view showing the relationship between a progress detection line and a progress detector according to the embodiment.
Figure 5B:
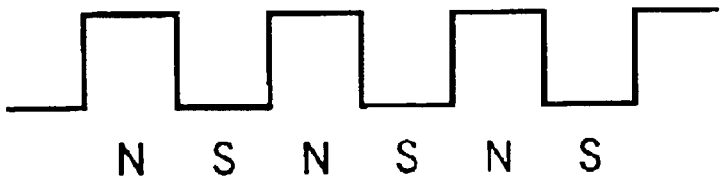
FIG. 5B is a schematic diagram showing a progress detection signal output form the progress detector.

To this end, as shown in FIG. 5A, progress lines 15 orthogonal to the guide lines are provided on the track at high density. The progress lines 15 are detected by a hole sensor 9 provided in the lower face of each self-propelled member 3. The number of progress lines 15 which the self-propelled member 3 has run across is counted, to thereby detect progress. The width of the progress line 15 may be selected from the range of 5 to 10 mm, as required. In the present embodiment, an N-pole magnetic line 15*a* having a width of 6 mm and an S-pole magnetic line 15*b* having a width of 6 mm are provided alternately. When the self-propelled member 3 runs across these magnetic lines, the hole sensor 9 detects the lines as a detection signal, such as that shown in FIG. 5B. As a result of the detection signal being converted through analog-to-digital conversion, the number of progress lines 15 which the self-propelled member 3 has run across can be detected. The thus-detected progress information is transmitted from each self-propelled member 3 to a central controller 20 (see FIG. 6).

The central controller 20 acquires progress information from all the self-propelled members 3, thereby ascertaining the positions of the self-propelled members 3 and the condition of a group of horses on the basis of the positional relationship between the miniatures 5 (in reality the positional relationship between the self-propelled members 3).

The principal traveling speed of each self-propelled member 3 is controlled on the basis of a speed control program assigned to a travel controller 16 of the self-propelled member 3 before a game is started, and in accordance with the characteristics of the self-propelled member 3 (e.g., a shake-off type, a last-spurt type, a sprinter type, or a longdistance runner type) and the strengths, weaknesses, and peculiarities of a jockey (the self-propelled members 3 assigned to win and place are controlled by a special speed control program after they have substantially passed by the third corner). Under the ever-changing condition of a group of horses, and under central control a determination is made as to whether to change the current guide line to another guide line, on the basis of conditions for determination; that is, the presence or absence of orientation of the self-propelled member toward the inner or outer side of the traveling course, and the presence or absence of the chance of the self-propelled member interfering with an adjacent self-propelled member.

A path-switching signal is sent to the self-propelled member which satisfies any one of the above conditions so that the traveling path of the subject self-propelled member is switched to an inner guide line or an outer guide line. In the present embodiment, if a self-propelled member is oriented (programmed) toward an inner side of the traveling path, priority is placed on path-switching to the inner side. In contrast, if a self-propelled member is oriented toward an outer side of the traveling course, priority is placed on path-switching toward the outer side. If no chance of the self-propelled member interfering with an adjacent self-propelled member is ascertained, an instruction for path-switching the course to a required direction is immediately issued.

Although the principal traveling speed is taken as a basic speed, a deceleration instruction is issued if there is a chance of occurrence of collision. A determination is made as to whether or not collision is impending, on the basis of a difference in the speed of a self-propelled member of interest and the speed of a self-propelled member running ahead or behind, and a distance between the self-propelled members. Here, a speed signal indicating a decelerated speed or a signal for instructing a reduction in speed may be issued. Moreover, principal traveling speed signals to be sent to the travel controllers 16 of the respective self-propelled members 3 may be transmitted collectively or in several transmissions on a per-segment basis.

In reality, path-switching control and deceleration control are performed on the basis of sequential determination operation allowing for various requirements set forth. In principle, one race is carried out through path-switching control and deceleration control on the basis of the above-described requirements.

Figure 6:
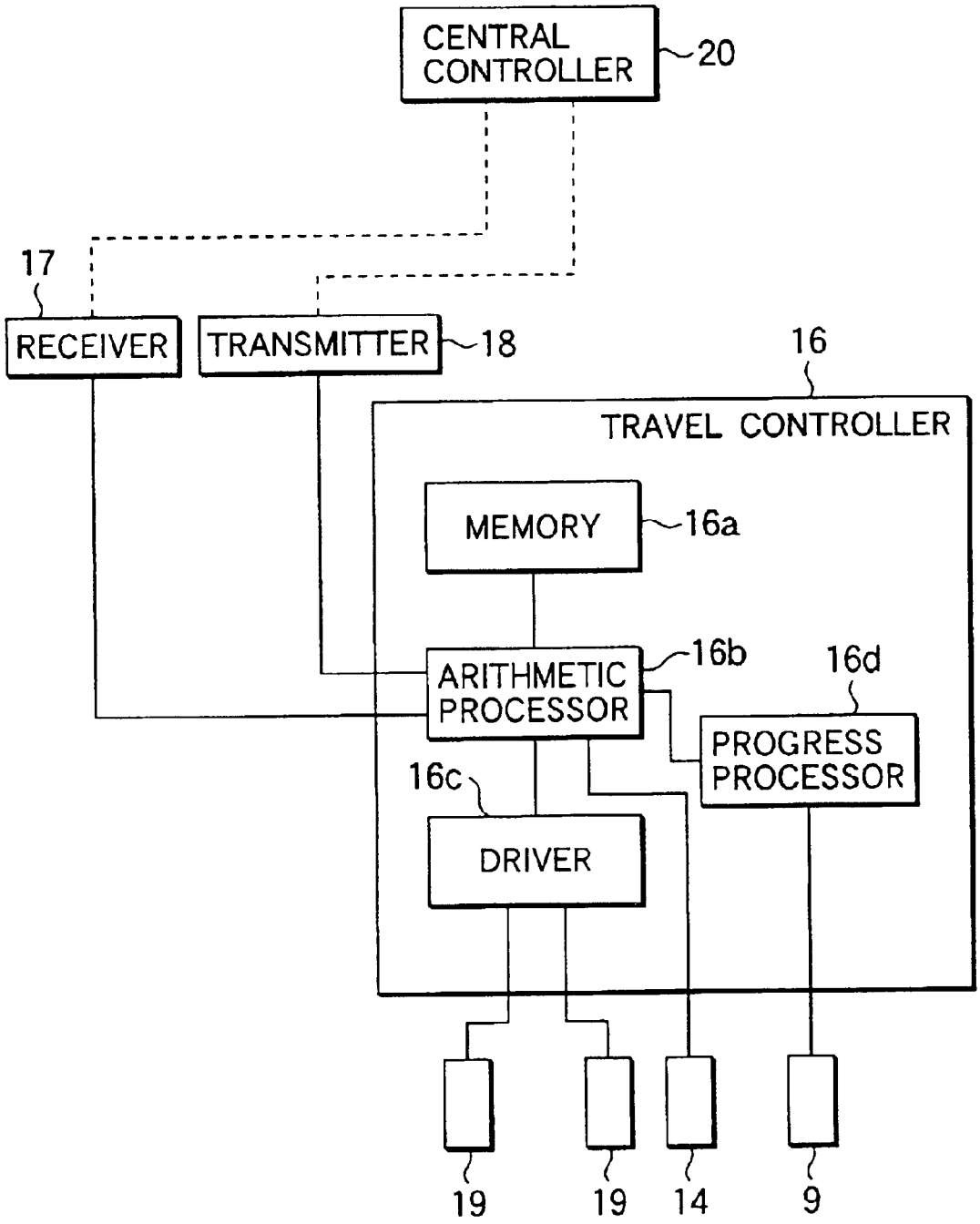
FIG. 6 is a block diagram of a travel controller according to the embodiment.

The functions of the travel controller 16 of the self-propelled member 3 and those of the central controller 20 are shown in FIG. 6. The signal transmitted from the central controller 20 to the travel controller 16 of the self-propelled member 3 includes principal speed data corresponding to the characteristic of each miniature to be transmitted before a race is started, a signal for steering the self-propelled member at the start of a race, and path-switching and deceleration signals to be issued during a race. Data pertaining to the principal speed to be employed for one race are output as principal traveling speeds for respective segments, provided that a race track is divided into a plurality of segments.

In the present embodiment, the entire race track for one race is divided into seven segments; namely, a straight segment between a starting line and the first corner; the first corner; the second corner; a straight segment between the second and third corners; the third corner; the fourth corner; and a segment between the fourth corner and a finish line. The principal traveling speed of the self-propelled member 3 does not always differ from one segment to another segment. The characteristic of a horse is represented by the number of segments. In view of simulation of a real horserace, provision of seven segments is sufficient.

A single principal traveling speed may be assigned to an individual self-propelled member. In this embodiment, the speeds of the self-propelled members are controlled separately on a per-segment basis in accordance with the characteristics of the miniatures.

The information transmitted from the travel controller 16 of the self-propelled member 3 to the central controller 20 constitutes progress information.

The travel controller 16 of the self-propelled member 3 controls rotational speeds of right and left wheel drive motors 19 so as to cause the self-propelled member 3 to travel while tracking a guide line 10 on the basis of the principal traveling speed signal. In response to a path-switching or deceleration instruction output from the central controller 20, the travel controller 16 accelerates or decelerates the wheel drive motors 19. If no path-switching or deceleration instruction is issued, the self-propelled member travels at the traveling speed matching the principal traveling speed data on the basis of the characteristics of the self-propelled member 3 from the start to the finish while following a single guide line.

The travel controller 16 has memory 16*a* for storing information output from the central controller 20, a driver 16*c* for controlling and activating an arithmetic processor 16*b* and the drive motors 19, and a progress processor 16*d*. The signal output from the central controller 20 is received by a receiver 17, and required data are saved in the memory 16*a*.

The travel controller 16 receives guide line detection signals output from the three photodiodes 14 of the self-propelled member 3. In accordance with the detection signals, the travel controller 16 detects a rightward or leftward deviation from the guide line 10. The travel controller 16 causes the self-propelled member to travel and follow the guide line 10 while correcting deviations therefrom. On the other hand, the progress processor 16*d* computes progress from a progress line 15 based on detection signal output from the hole sensor 9. The resultant progress information is sent to the central controller 20 by way of a transmitter 18.

On the basis of the progress information items sent from the respective self-propelled members 3, the central controller 20 successively ascertains the condition of a group of horses and, in accordance with the predetermined conditions for determination, makes a determination as to a necessity for path-switching a guide line or deceleration, thereby sequentially sending path-switching and deceleration signals to the respective self-propelled members 3.

The central controller 20 successively ascertains the condition of a group of horses and controls required path-switching operation or traveling speed on the basis of the thus-ascertained condition. Feedback of information about progress in a self-propelled member to progress control is not required; the only requirement for enhancing the accuracy of progress tracking is to cause the central controller 20 or the controller provided in the self-propelled member to perform feedback control.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A racing game machine, comprising:

a lower traveling field;

a plurality of guide lines provided on the lower traveling field;

a plurality of self-propelled members, each including:

a first detector, which detects at least one of the guide lines by at least one of optically and magnetically;

a second detector, which outputs a displacement signal which indicates a displaced distance from a predetermined position; and a travel controller, which performs a feedback control such that the self-propelled member travels on the lower traveling field while tracing the at least one guide line;

an upper traveling field, extending above the lower traveling field;

a plurality of miniature members, each associated with one self-propelled member, the miniature members placed on the upper traveling field so as to travel thereon in accordance with the traveling of the self-propelled members through magnetic force;

a central controller, which collectively monitors the displacement signal of each self-propelled member to recognize relative position relationship among the self-propelled members, and which issues at least a speed changing instruction and a path-switching instruction for each self-propelled member, based on the relative position relationship, wherein the travel controller of each self-propelled member changes a traveling speed thereof when the speed changing instruction is received from the central controller; and wherein the travel controller of each self-propelled member switches a traveling path thereof from the traced guide line to another guide line, when the path-switching instruction is received from the central controller.

2. The racing game machine as set forth in claim 1, wherein a reference speed is assigned to each self-propelled member in accordance with a characteristics of an associated miniature member.

3. The racing game machine as set forth in claim 1, wherein the central controller determines a goal-arrival order of a game prior to a start of the race, so as to include at least a first-arrived miniature member and a second-arrived miniature member.

4. The racing game machine as set forth in claim 1, wherein the central controller issues the speed changing instruction when at least one of the following requirements is satisfied:

i) a speed difference between two of the self-propelled members traveling on the same guide line is a predetermined value or more; and ii) a distance between two of the self-propelled members is a predetermined value or less; and wherein the speed changing instruction is an instruction for decelerating one of the self-propelled members which is situated rearward.

5. The racing game machine as set forth in claim 1, wherein the displacement signal is feedback controlled by the central controller.

6. The racing game machine as set forth in claim 1, wherein the displacement signal is feedback controlled by the travel controller.

7. The racing game machine as set forth in claim 1, wherein the displacement signal is open controlled.

8. The racing game machine as set forth in claim 1, wherein each of said travel controllers corrects a course of said self-propelled member through feedback control based on a deviation of said self-propelled member from one of said guide lines.

9. A racing game machine, comprising:

a lower traveling field;

a plurality of guide lines provided on the lower traveling field;

a plurality of progress lines provided on the lower traveling field at constant intervals, so as to perpendicularly cross each guide line;

a plurality of self-propelled members, each including:

an optical detector, which detects at least one of the guide lines;

a magnetic detector, which outputs a displacement signal indicating how many number of progress lines are passed by the self-propelled member from a predetermined position; and a travel controller, which performs a feedback control such that the self-propelled member travels on the lower traveling field while tracing the at least one guide line;

an upper traveling field, extending above the lower traveling field;

a plurality of miniature members, each associated with one self-propelled member, the miniature members placed on the upper traveling field so as to travel thereon in accordance with the traveling of the self-propelled members through magnetic force;

a central controller, which collectively monitors the displacement signal of each self-propelled member to recognize relative position relationship among the self-propelled members, and which issues at least a speed changing instruction and a path-switching instruction for each self-propelled member, based on the relative position relationship, wherein the travel controller of each self-propelled member changes a traveling speed thereof when the speed changing instruction is received from the central controller; and wherein the travel controller of each self-propelled member switches a traveling path thereof from the traced guide line to another guide line, when the path-switching instruction is received from the central controller.

10. The racing game machine as set forth in claim 9, wherein the central controller determines a goal-arrival order of a game prior to a start of the race, so as to include at least a first-arrived miniature member and a second-arrived miniature member.

11. The racing game machine as set forth in claim 9, wherein the optical detector includes at least three optical sensors arranged in a direction perpendicular to a traveling direction of the self-propelled member.

12. The racing game machine as set forth in claims 9, wherein the guide lines are provided as black lines and white lines which are alternately printed on the lower traveling field.

13. The racing game machine as set forth in claim 9, wherein the central controller issues the speed changing instruction when at least one of the following requirements is satisfied:

i) a speed difference between two of the self-propelled members traveling on the same guide line is a predetermined value or more; and ii) a distance between two of the self-propelled members is a predetermined value or less; and wherein the speed changing instruction is an instruction for decelerating one of the self-propelled members which is situated rearward.

14. The racing game machine as set forth in claim 9, wherein the displacement signal is feedback controlled by the central controller.

15. The racing game machine as set forth in claim 9, wherein the displacement signal is feedback controlled by the travel controller.

16. The racing game machine as set forth in claim 9, wherein the displacement signal is open controlled.

17. The racing game machine as set forth in claim 9, wherein each of said travel controllers corrects a course of said self-propelled member through feedback control based on a deviation of said self-propelled member from one of said guide lines.

* * * * *